United States Patent [19]

Gudjonsson

[11] 4,109,682

[45] Aug. 29, 1978

[54] DIRECTIONAL CONTROL VALVE

[76] Inventor: Ellidi N. Gudjonsson, Lindarflot 37, Gardabaer, Iceland

[21] Appl. No.: 764,080

[22] Filed: Jan. 31, 1977

[51] Int. Cl.[2] ..... F15B 13/04

[52] U.S. Cl. ..... 137/625.23; 137/596.12; 137/625.24

[58] Field of Search ..... 137/596.12, 625.23, 137/625.24

[56] References Cited

U.S. PATENT DOCUMENTS

| | | | |
|---|---|---|---|
| 2,234,322 | 3/1941 | Sicard | 137/625.23 |
| 3,918,494 | 11/1975 | Dalton | 137/625.23 |

*Primary Examiner*—Gerald A. Michalsky

*Attorney, Agent, or Firm*—Flynn & Frishauf

[57] ABSTRACT

A valve for supplying pressure fluid to an output utilization device, such as a motor, in a continuous manner from zero to maximum pressure in first and second directions comprises a valve block having a valve bore therein, and a valve spool which is rotatably mounted in the valve bore. The valve block has various passages in communication with the valve bore and the valve spool has circumferential recesses, longitudinally directed grooves and a through-hole therein which are in selective communication with the various passages of the valve block to provide variable pressure fluid flow in first and second directions to an output utilization device which is coupled to a pair of passages of said valve block.

11 Claims, 7 Drawing Figures

DIRECTIONAL CONTROL VALVE

This invention relates to valves, and more particularly, to a hydraulic valve for controlling, for example, a hydraulic motor in a continuous manner from full stop positions to maximum speed positions in opposite directions of rotation of the motor.

The object of the present invention is to provide such a valve which is of extremely simple design, which is roughed with a minimum number of moving parts, and which is simple to manufacture.

A further object of the invention is to provide such a valve with a maximum speed controlling device also of simple construction and which is of simple operation.

SUMMARY OF THE INVENTION

A valve according to the present invention comprises a valve body having a valve bore therein, a first port for receiving a pressure fluid, a second port for discharging pressure fluid, and third and fourth ports for connection to an output utilization device, the first, second, third and fourth ports all being in communication with said valve bore. A valve spool has a first circumferential groove or recess which is in communication with the third port, a second circumferential groove or recess spaced from the first circumferential groove or recess and in communication with the fourth port, a through hole therein which is in selective communication with the first and second ports, a groove which is in selective communication with the first and second ports and which extends from the vicinity of the first port to the first circumferential recess, and a further groove which is in selective communication with the first and second ports and which extends from the vicinity of the first port to the second circumferential recess. The valve spool is rotatable in the valve bore such that when the through bore of the valve spool is in full communication with the first and second ports, the output utilization device is effectively shunted and rendered in the off condition, when the first groove is in full communication with the first port, the output utilization device is operated at maximum in a first direction and when the second groove is in full communication with the second circumferential recess the output utilization device is operated at maximum in an opposite direction. The pressure of the pressure fluid is continuously varied throughout the complete range of control by means rotating the valve spool.

In a preferred arrangement the valve spool is an elongated rod-shaped element which is rotatable in the valve bore about its longitudinal axis. In this embodiment, the non-circumferential grooves run generally in the direction of the longitudinal axis of the valve spool and are on diametrically opposite sides of the valve spool.

In a further preferred arrangement, the valve device comprises a bypass valve for regulating the maximum pressure of the pressure fluid coupled to the output utilization device.

DETAILED DESCRIPTION

Figure 1:
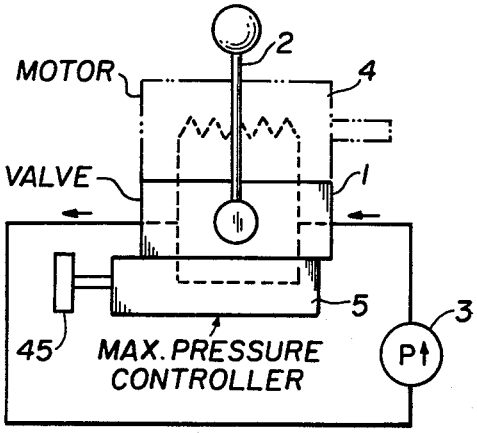
FIG. 1 is a schematic drawing showing the valve of the present invention connected to a motor device.

Referring to FIG. 1, a valve 1 having a control handle 2 is connected to a source of pressure fluid 3. An output utilization device, such as a pressure fluid operated motor 4 (i.e., a hydraulic motor) is coupled to the valve 1 so as to receive pressure fluid for operation of the motor 4, such as over the path illustrated by broken lines in FIG. 1. A bypass control valve 5 is coupled to the valve 1 and is in fluid communication with the pressure source 3 as indicated by the dashed lines in FIG. 1. The detailed operation of the device shown in FIG. 1 will be described further below.

Figure 2:
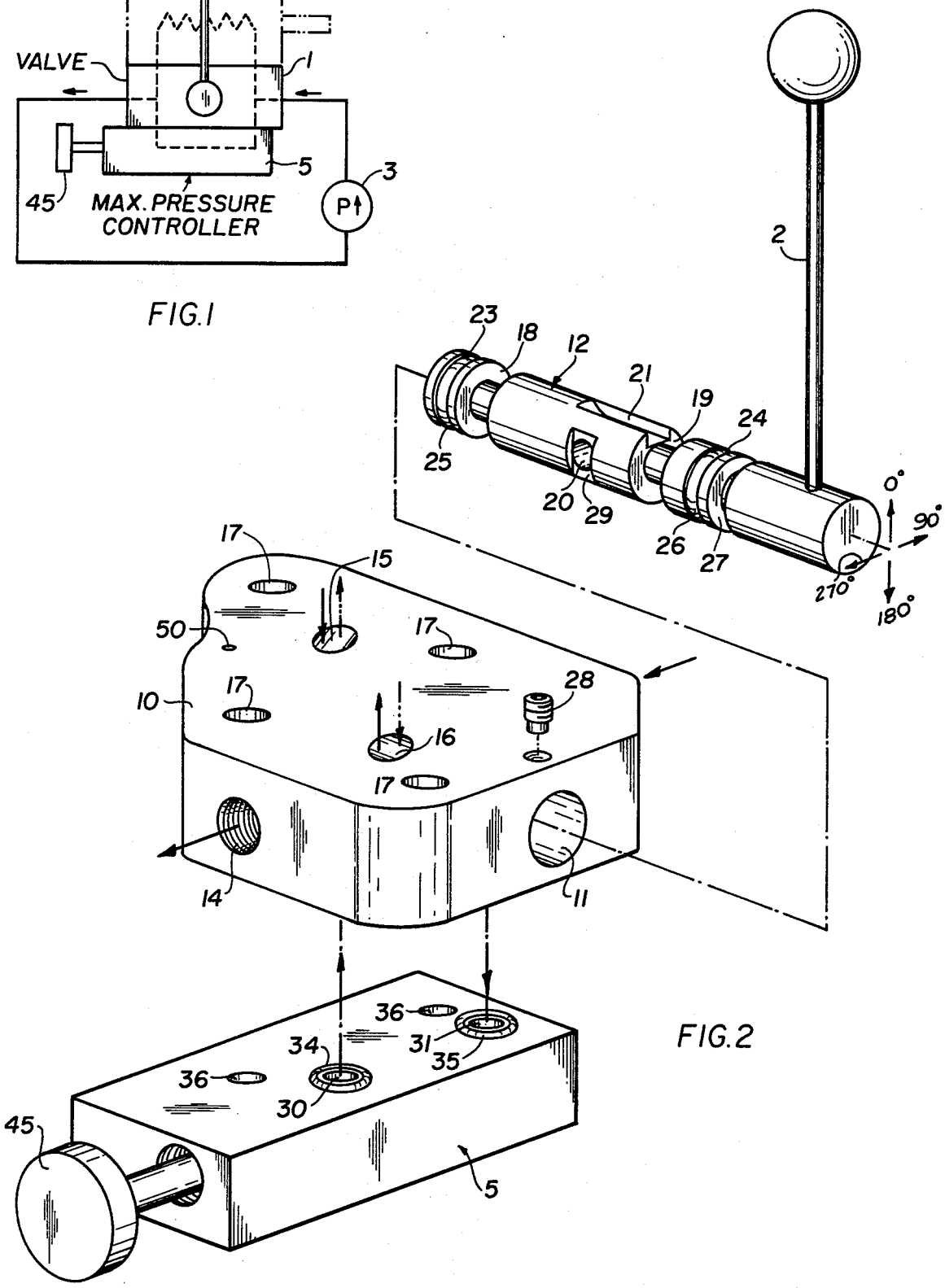
FIG. 2 illustrates the valve of the present invention in greater detail, in disassembled state.
Figure 3:
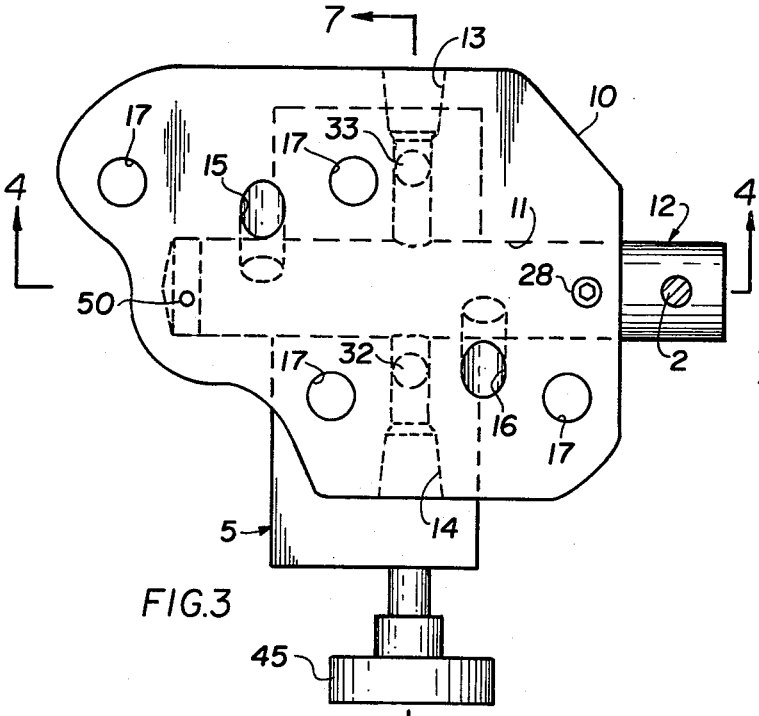
FIG. 3 is a top view of the valve of the present invention.

Referring to FIG. 2, the valve 1 comprises a valve body 10, which is preferably fabricated of a solid block of material, such as metal. The valve body has a valve bore 11 therein for receiving a valve spool 12 which is rotatably mounted therein. The valve body 10 has a first bore 13 (FIG. 3) which is coupled to the pressure fluid source 3 and a second bore 14 through which pressure fluid exits the valve body. The valve body 10 further has third and fourth ports 15, 16 which are angularly oriented in the valve body 10 so as to communicate with the valve bore 11, for example as illustrated in FIG. 3. The bores 13 and 14 likewise communicate with valve bore 11 as illustrated in FIG. 3. The output utilization device, such as a motor 4 is bolted to the valve body 10 along the upper surface thereof as seen in FIG. 2 so that the inputs and outputs of the motor are in registration with the openings of the bores 15 and 16. The valve block also has through mounting holes 17 for bolting the valve body to a motor, or the like, in fluid tight relationship. If necessary, a gasket can be used on the upper surface of the valve block interposed between the valve block 10 and the motor 4.

The spool 12 has first and second circumferential recesses 18, 19 and a through hole 20 interposed between the recesses 18, 19. The valve spool is also provided with a first groove 21 in the axial direction thereof and in communication with recess 19, and with a second groove 22 (see FIGS. 4 and 5) on the side thereof opposite groove 21, the second groove 22 extending axially and being in communication with the circumferential recess 18. Preferably, the grooves 21, 22 are diametrically opposite each other and lie generally in a plane which is perpendicular to the axis of the through hole 20.

The valve spool 12 is further provided with circumferential recesses 23, 24 located outboard of the recesses 18, 19 for receivng respective O-rings 25, 26 therein for sealing against the inner surface of valve bore 11. The valve spool 12 is further provided with another recess 27 which extends circumferentially thereof in which is engaged a threaded set screw 28 for retaining the valve spool 12 in the valve bore 11. After insertion of the spool 12 into the bore 11, the set screw 28 is screwed down into the block 10 so that the end portion thereof engages in the circumferential recess 27. See FIG. 4.

The various shoulders between the circumferential recesses and the axial grooves are dimensioned so as to have a close fit in the valve bore 11 so as to provide a substantial seal against undesirable flow of pressure fluid in the clearance spaces. A groove defining a flat cut-out portion 29 is formed in the valve spool 12 at each end of the through bore 20. This is to provide better communication with the inlet and outlet fluid. The flat portions 29 extends only over a limited portion of the circumference of the valve spool 12.

A maximum pressure regulator valve 5 has bores 30, 31 therein which communicate with bores 32, 33, respectively (see FIG. 3) of the valve body 10. O-rings 34, 35 are provided around the openings of the bores 30, 31, respectively, to provide a seal between the pressure regulating valve and the valve body 10. The pressure regulating valve 5 is mounted in substantially surface contact to the bottom surface of the valve body 10 through mounting holes 36 which are in registration with two of the mounting holes 17 of the valve body, as should be apparent from FIGS. 2 and 3.

Figure 7:
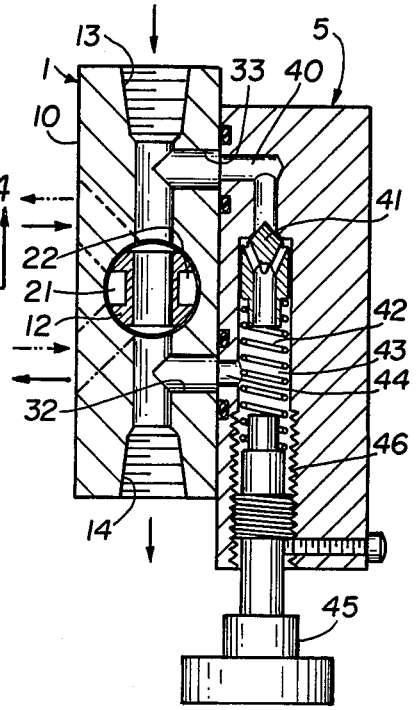
FIG. 7 is a sectional view taken along the line 7—7 in FIG. 3.

Referring to FIG. 7, the pressure regulating valve 5 comprises an internal passage 40 in communication with bore 33 of the valve body, the internal passage 40 ending in a valve seat. A valve member 41 is spring biased against the valve seat at the end of the passage 40 by means of a spring 42. The spring 42 is located in a further passage 43 which, when the valve is opened, is in communication with passage 40. A further passage 44 is provided in the valve 5 which is in communication with the bore 32 of the valve body 10. The biasing pressure of the spring 42 is adjusted by means of a threaded knob 45 which is threadably inserted in the threaded portion 46 of the passage 43. When the pressure in passage 40, which is in communication with the pressure fluid source 3 via the bores 13 and 33 of the valve body 10, increases to a pressure corresponding to the biasing pressure of the spring 42, then valve member 41 is lifted off the seat against the biasing pressure of the spring 42 and pressure fluid is bypassed around the valve spool through the passage 40, passage 43 and passage 44 of the regulating valve body 5. This effectively shunts the valve 1 when the pressure exceeds a given pressure. When the output utilization device 4 is a hyraulic motor, for example, then the maximum speed of the hydraulic motor may be preset by adjusting the pressure of the spring 42 against the valve member 41 in the pressure regulating device. By regulating the maximum pressure fed to the motor, by shunting the pressure fluid at a given pressure value, the speed of operation of the motor is easily and expediently varied.

Further provided in the valve body 10 is a vent hole 50.

OPERATION

Figure 4:
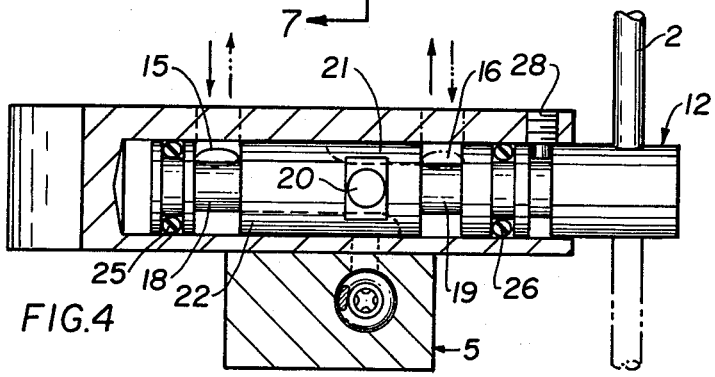
FIG. 4 is a sectional view of the valve of the present invention taken along the line 4—4 in FIG. 3, with the valve spool being shown in full.
Figure 5:
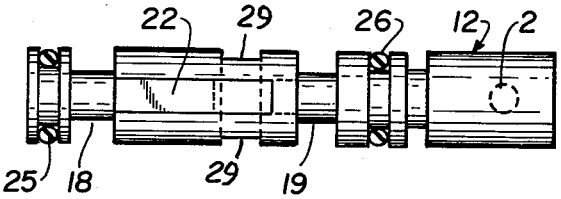
FIG. 5 is a bottom view of the valve spool.
Figure 6:
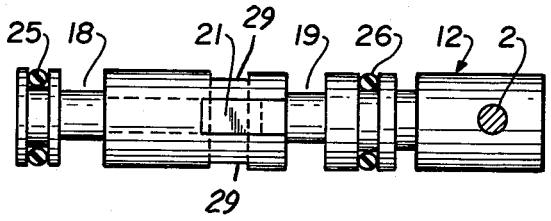
FIG. 6 is a top view of the valve spool.

When the valve spool 12 is in the position shown in FIG. 2, the through bore 20 is in full communication with the passages 13, 14 in the valve body. Thus, all of the pressure fluid from pressure fluid source 3 passes through the bore 20 in the valve spool, thereby shunting the output utilization device 4, such as a motor, and rendering the output utilization device inoperative. As the handle 2 is rotated toward the 90° point (indicated in FIG. 2), the amount of shunting fluid decreases since the communication between the through bore and the inlet channel 13 becomes gradually decreased, and the communication between the upper groove 21 and the inlet channel 13 begins to increase. This causes the inlet pressure fluid to flow through the groove 21 into the circumferential recess 19 and then into the output utilization device 4 via the port 16 which is in registration with the circumferential recess 19, as clearly seen in FIG. 4. When the handle is rotated to the 90° point as seen in FIG. 2, maximum communication between the channel 21 and the inlet passage 13 is achieved, thereby providing maximum fluid flow to the output utilization device 4. As the handle is turned toward the 180° point, communication between the groove 21 and the inlet channel 13 gradually decreases and communication between the through hole 20 and the inlet port increases. Thus, at the 180° point, full communication between the through bore 20 and the inlet channel 13 is achieved, thereby again shunting the motor 4 and rendering it inoperative. As the handle is turned toward the 270° point, the lower groove 22 becomes more and more in communication with the inlet channel 13, as the through bore 20 becomes more and more out of communication with the inlet channel 13. Thus, fluid increasingly flows, with increasing rotation of the handle toward the 270° point, through groove 22 to circumferential recess 18 and thus into the output utilization device 14 through the port 15 which is in registration therewith, as seen in FIG. 4. This causes fluid to flow into the output utilization device in the opposite direction, that is, from port 15 through the motor and out through port 16, thereby causing the motor or output utilization device to operate in the opposite direction.

Since the grooves 21, 22 are diametrically opposite to each other, when one of the grooves is in pressure fluid communication with the inlet port 13, the other of the grooves is in exhaust fluid communication with the output port 14 of the valve block 10.

As should be apparent from the above, the valve arrangement of the present invention provides continuous variable pressure adjustment of the pressure fluid provided to an output utilization device, such as a motor, and moreover provides a continuous reversal of direction of the supply of pressure fluid to the output utilization device. The advantageous effects are achieved with simple structure which does not require complicated machining and which should have a long useful life. The various bores are all straight line bores which may be simply drilled into a metallic valve block and the valve spool may be simply manufactured using, for example, a lathe, except for the axial grooves 21, 22 and the flat spots 29 on opposite sides of the spool adjacent the openings of the through bore 20. Moreover, due to the simple construction, a maximum pressure regulating valve 5, of simple construction, may be readily attached to the control valve to further enhance the operational performance and provide a greater degree of control.

While the apparatus has been described with respect to specific embodiments, it should be clear that various modifications and alterations may be made within the scope of the appended claims. For example the material from which the device is made may be other than metal, the specific type of material depending upon the application of the device.

I claim:

1. A valve comprising:

a valve body (10) having a valve bore (11) therein, a first port (13) for receiving a pressure fluid, a second port (14) for discharging pressure fluid, and third and fourth ports (15, 16) for connection to an output utilization device, said first, second, third and fourth ports (13–16) all being in communication with said valve bore (11); and an elongated generally rod-shaped valve spool (12) rotatably received in said valve bore (11), said valve spool having a first circumferential recess (18) which is in communication with said third port (15); a second circumferential recess (19) spaced from said first circumferential recess (18) and in communication with said fourth port (16); a through bore (20) located between said first and second circumferential recesses and at a given axial position of said valve spool such that it is in selective communication with said first and second ports (13, 14); a first straight groove (22) which is in selective communication with said first port (13) and which extends axially of said valve spool (12) from at least said given axial position of said valve spool to said first circumferential recess (18); a second straight groove (21) which is in selective communication with said first port (13) and which extends axially of said valve spool (12) from at least said given axial position of said valve spool to said second circumferential recess (19), said first and second grooves (22, 21) being on diametrically opposite sides of said valve spool and said through bore (20) having an axis which is substantially perpendicular to the longitudinal axis of said valve spool, said axis of said through bore (20) being substantially perpendicular to a plane passing through said first and second grooves; and a further groove (29) in said valve spool at each end of said through bore (20), said further grooves being substantially perpendicular to said first and second grooves (22, 21) and out of communication with said first and second grooves, the angular communication of said through bore (20) with said first and second ports (13, 14) being greater than that of said first and second grooves (22, 21); and means for rotating said valve spool (12) in said valve bore (11) whereby when said through bore (20) of said valve spool is in full communication with said first and second ports (13, 14), the output utilization device is shunted and rendered in the off condition, when said first groove (22) is in full communication with said first port (14), the output utilization device is operated at maximum in a first direction and when said second groove (21) is in full communication with said first port the output utilization device is operated at maximum in an opposite direction.

2. A valve according to claim 1 further comprising sealing means at the end portions of said valve spool at outboard positions relative to said circumferential recesses for providing a fluid-tight seal between said valve bore and said valve spool.

3. A valve according to claim 2 further comprising means for retaining said valve spool in said valve bore.

4. A valve according to claim 1 further comprising fourth and fifth ports respectively coupled to said first and second ports, and bypass valve means removably coupled to said fourth and fifth ports for selectively bypassing fluid from said first port to said second port without communicating with said valve spool.

5. A valve according to claim 4 wherein said bypass valve means bypasses said fluid at a predetermined pressure, thereby limiting the pressure of fluid fed to said output utilization means.

6. A valve according to claim 1 further comprising bypass valve means removably coupled to said first and second ports for selectively bypassing fluid from said first to said second port without communicating with said valve spool.

7. A valve according to claim 6 wherein said bypass valve means bypasses said fluid at a predetermined pressure, thereby limiting the pressure of fluid fed to said output utilization means.

8. A valve according to claim 6 wherein said bypass valve means comprises a bypass valve body removably connected to said valve body (10), a channel in said bypass valve body in communication with said first and second ports, a valve seat in said channel, a valve member in said channel and in communication with said valve seat, and spring means biasing said valve member against said valve seat.

9. A valve according to claim 8 further comprising means for adjusting the spring pressure of said spring against said valve seat.

10. A valve according to claim 1 further comprising third and fourth circumferential recesses in the end portions of said valve spool at outboard positions relative to said first and second circumferential recesses, and sealing means in said third and fourth circumferential recesses for providing a fluid-tight seal between said valve bore and said valve spool.

11. A valve according to claim 1 wherein said first, second, third and fourth ports each comprise substantially straight-line bores in said valve body.

* * * * *